US009248930B1

(12) United States Patent
Dobbins

(10) Patent No.: US 9,248,930 B1
(45) Date of Patent: Feb. 2, 2016

(54) REUSABLE BAGS WITH SECURING RING

(71) Applicant: Marilyn A. Dobbins, Seminole, FL (US)

(72) Inventor: Marilyn A. Dobbins, Seminole, FL (US)

( * ) Notice: Subject to any disclaimer, the term of this patent is extended or adjusted under 35 U.S.C. 154(b) by 101 days.

(21) Appl. No.: 13/835,096

(22) Filed: Mar. 15, 2013

(51) Int. Cl.
*B65B 67/12* (2006.01)

(52) U.S. Cl.
CPC ..... *B65B 67/1222* (2013.01); *B65B 67/12* (2013.01)

(58) Field of Classification Search
CPC ..... B65F 1/1415; A45F 5/00
USPC ..... 248/95; 383/2, 4, 6; 150/100, 107, 130; 224/576; 220/751; 29/428
See application file for complete search history.

(56) References Cited

U.S. PATENT DOCUMENTS

| | | | | |
|---|---|---|---|---|
| 2,671,486 | A | 3/1954 | Shaw | |
| 4,090,542 | A | 5/1978 | Hacker, Jr. | |
| 5,009,516 | A | 4/1991 | Geeck | |
| 6,131,733 | A * | 10/2000 | Ergle | 206/315.1 |
| 6,640,856 | B1 * | 11/2003 | Tucker | 150/130 |
| 2011/0142374 | A1 | 6/2011 | Deck et al. | |
| 2011/0253731 | A1 * | 10/2011 | Smith | 220/751 |
| 2011/0309121 | A1 * | 12/2011 | Dooley | 224/576 |

* cited by examiner

*Primary Examiner* — Todd M Epps
(74) *Attorney, Agent, or Firm* — Robert C. Montgomery; Montgomery Patent and Design, LLC

(57) ABSTRACT

A plurality of detachable and foldable shopping bags is further provided with a securing ring. When a bag is completely folded-up it is secured from unfolding via fastening element. The bag can then be fastened onto the securing ring via a spring clip for storage. A desired amount of bags can be removed from the securing ring when needed to retain items. The securing ring also comprises another spring clip utilized to secure the ring with attached bags onto a desired item.

4 Claims, 3 Drawing Sheets

REUSABLE BAGS WITH SECURING RING

RELATED APPLICATIONS

Not applicable.

FIELD OF THE INVENTION

The present invention relates generally to securing at least one (1) flexible and resilient bag in a compact state to a securing ring for further transportation or storage thereof.

BACKGROUND OF THE INVENTION

Recreational activities, including shopping, often times necessitate a means to carry recreational accessories, or shopped items as the case may be. It is desirous to have convenient access to a carrying apparatus(es) for such purposes. It is also desirous to be alleviated of the burdens and restrictions associated with maintaining such convenient access to these carrying apparatus(es).

Light-weight shopping and tote bags exist. Currently, convenient access to such bags either requires a user to transport the bags on their person or having the bags marshalled at the recreational/shopping site. Both forms of convenient access impose restrictions on the user. Transporting the bags on their person imposes the burdens of stowing and hauling the bags, which can be unsightly, annoying, and awkward. Having the bags marshalled at the recreational/shopping site limits the user in exercising discretion regarding the type of bag to be used because the user is forced to use a bag that is most conducive to the operator of the recreational/shopping site. Furthermore, shopping establishments are increasingly becoming "bagless", requiring patrons to bring and use their own bags. This effort to become bagless reduces cost for the business and is generally more salutary to environmental sustainability efforts by reducing refuse, especially plastic refuse. Even where shopping establishments have not become bagless, patrons frequently do not obtain a bag until after checking out. Therefore, patrons are forced to hand-carry their shopped items as they continue to peruse the store before finally checking out.

It is desirable to avail oneself of the benefits of both forms of convenient access while reducing the burdens and restrictions associated with either form. In doing so, it would be beneficial to have a device that would conveniently stow a plurality of bags in a compact and easily accessible manner. Additionally, that device would stow the bags in an aesthetically pleasing configuration. Another desirable feature is for the device itself to removably attach by way of a lanyard to purses, key chains, and the like.

SUMMARY OF THE INVENTION

The present invention relates to a plurality of reusable, foldable bags and a securing ring, which provides a means for storing reusable bags in a ready and convenient manner. A plurality of bags is attached to the securing ring by way of a bag clip, which tethers a loop of each bag to the securing ring. Each bag is equipped with at least one (1) integral handle located at a top portion of each bag. Each bag is further provided with extension straps with integral snap fastener to assist with maintaining the bag in a compacted state. The securing ring is equipped with a lanyard clip enabling the securing ring, with the bags attached, to be attached to other items for ease of transport of the device.

A user attaches each bag by first folding the bag into a compact state. After the bag is folding into itself, extension straps are used to secure and maintain the bag in the folded form. The bag clip, attached to the exposed bag loop, is then used to attach the bag to the securing ring. The lanyard clip is attached to the securing ring and can be used to attach the securing ring, along with a plurality of compacted bags, to other items such as a purse or key chain.

The use of the present invention affords a user the ability to have convenient access to shopping and tote bags at the user's discretion. Having access to a plurality of bags at the user's disposal alleviates the restriction of limited variety. The bags, in their compact sate, attached to the securing ring form a device that is easily stowable, light weight, and transportable.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
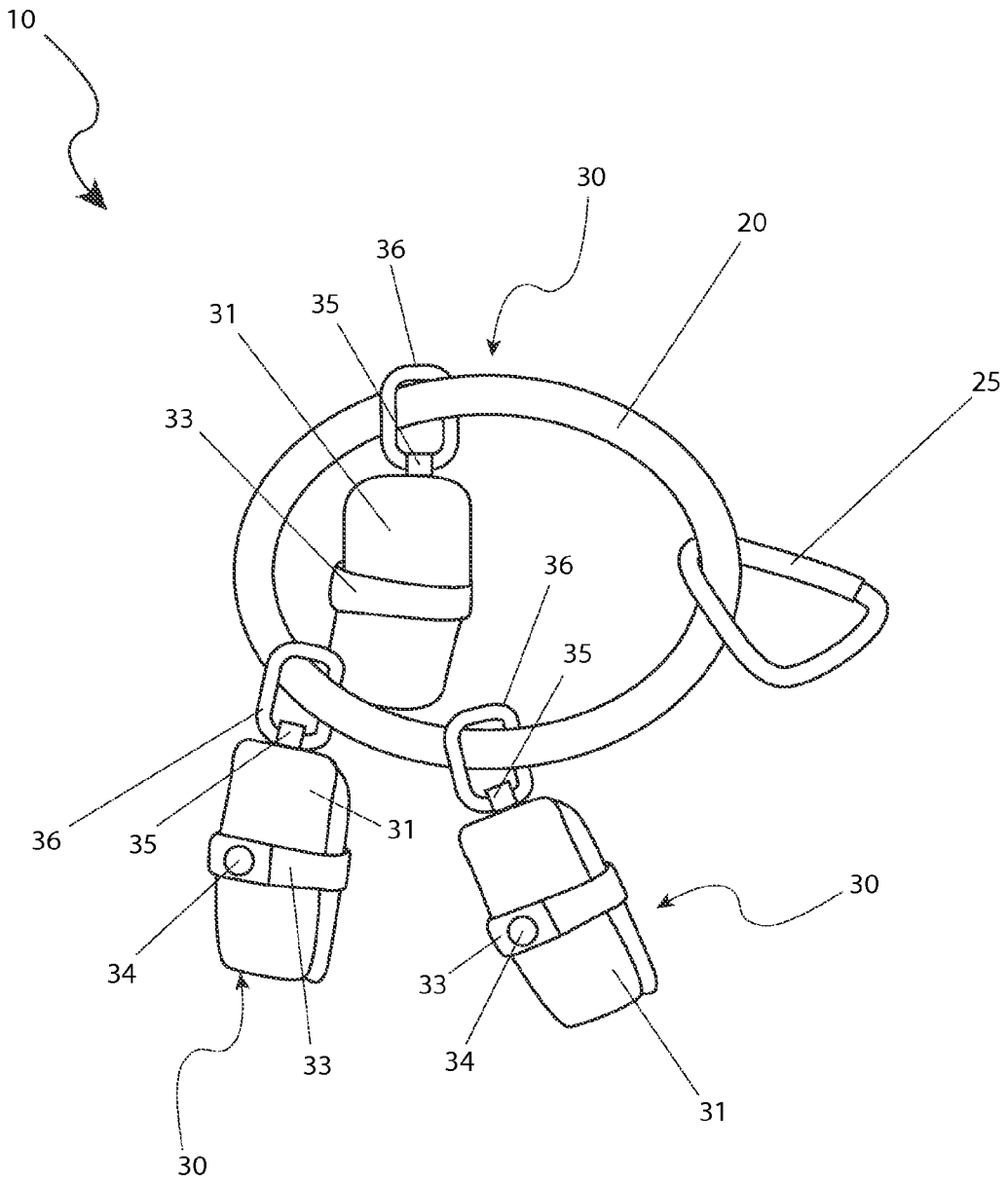
FIG. 1 is a perspective view of reusable bags with a securing ring 10, according to a preferred embodiment of the present invention.

10 reusable bags with a securing ring
20 securing ring
25 securing ring clip
30 reusable bag
31 bag
32 handle
33 extension strap
34 snap fastener
35 loop
36 bag clip
37 inner surface

DETAILED DESCRIPTION OF THE PREFERRED EMBODIMENT

In accordance with the invention, the best mode is presented in terms of the described embodiments, herein depicted within FIGS. 1 through 5. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the"" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

The present invention describes a plurality of reusable bags 30 and a securing ring 20 and system of use therefore (herein described as the "system") 10, which provides a means for storing reusable bags 30 in a ready and convenient manner that are always ready to use. The system 10 is preferably attached onto a user's purse, keychain, or other similar item.

Referring now to FIG. 1, a perspective view of the system 10, according to the preferred embodiment of the present invention, is disclosed. The system 10 comprises a securing ring 20 and at least one (1) reusable bag 30. The securing ring 20 is preferably fabricated from materials such as metal, plastic, or the like. The securing ring 20 includes a securing ring clip 25 which enables the securing ring 20 to be attached and secured to a desired item such as a purse or keychain. The securing ring clip 25 is preferable a common spring-loaded clipping device, yet other attachment means may be utilized without limiting the scope of the invention. The securing ring 20 enables each reusable bag 30 to be attached upon its exterior circumference. FIG. 1 depicts three (3) reusable bags 30 attached to the securing ring 20 for illustration purposes, only it is known multiple reusable bags 30 may be attached, depending on the capacity of the securing ring 20, without limiting the scope of the system 10. The securing ring 20 shall be provided at an appropriate diameter to retain the maximum limit of reusable bags 30 in a non-cluttered manner, thereby enabling an ease of removing and utilizing the reusable bags 30.

Figure 2:
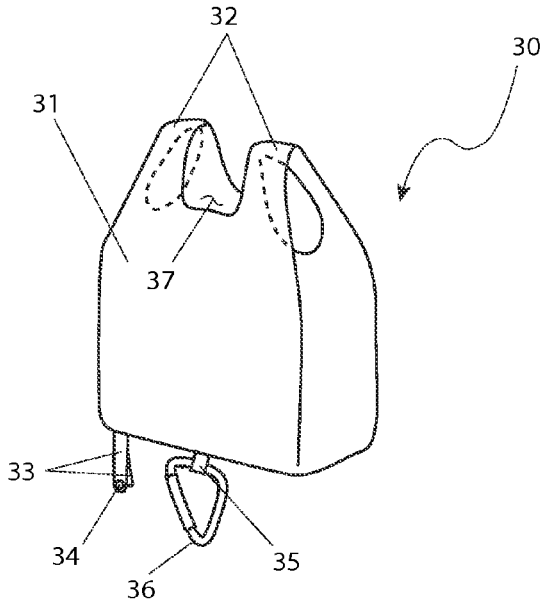
FIG. 2 is a perspective view of an individual reusable bag 30 depicted in an unfolded and opened state, according to a preferred embodiment of the present invention.
Figure 3:
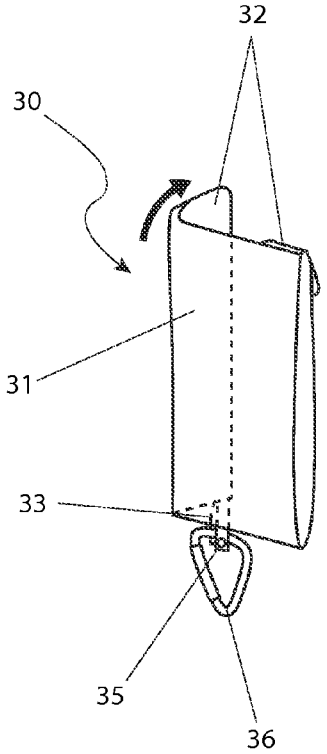
FIG. 3 is another perspective view of the reusable bag 30 of FIG. 2 depicted in a flattened and semi-folded state, according to a preferred embodiment of the present invention.
Figure 4:
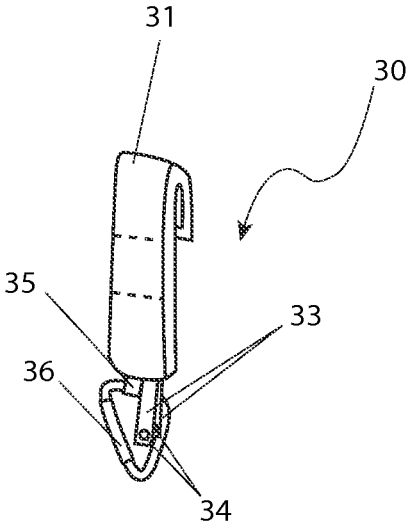
FIG. 4 is another perspective view of the reusable bag 30 of FIG. 2 depicted in a folded and semi-rolled state, according to a preferred embodiment of the present invention; and, FIG. 5 is yet another perspective view of the reusable bag 30 of FIG. 2 depicted in a folded, rolled, and secured state, according to a preferred embodiment of the present invention.
Figure 5:
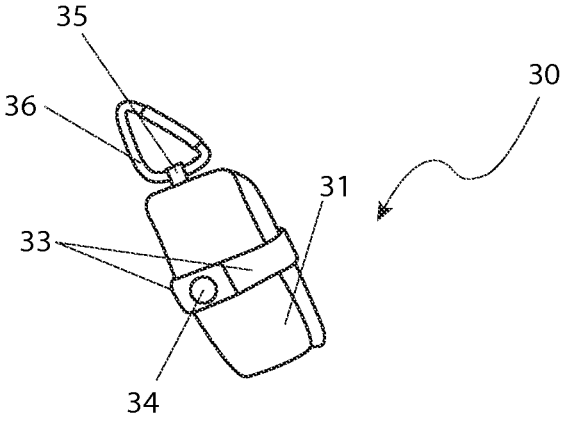

Referring now to FIGS. 2 through 5, various views of the reusable bag 30, according to the preferred embodiment of the present invention, is disclosed. FIG. 2 illustrates a perspective view of an individual reusable bag 30 depicted in an unfolded and opened state, FIG. 3 illustrates another perspective view of the reusable bag 30 depicted in a flattened and semi-folded state, FIG. 4 illustrates another perspective view of the reusable bag 30 depicted in a folded and semi-rolled state, FIG. 5 illustrates yet another perspective view of the reusable bag 30 depicted in a folded, rolled, and secured state.

The reusable bags 30 comprise a plurality of open-topped "U"-shaped bags 31 which further comprise a pair of opposing and integral handles 32 upon an upper portion. The bags 31 are preferably fabricated from materials such as, but not limited to: cloth, nylon, or other similar textile materials. The bags 31 also are manufactured in various colors and patterns to accommodate the preferences of the user. An inner surface 37 of each bag 31 is utilized to retain desired items such as groceries, clothes, or the like. A lower perimeter edge of each bag 31 also comprises a pair of extension straps 33 which are utilized to secure a bag 31 in a folded and rolled state (see FIG. 5). A lower intermediate perimeter edge of each bag 31 also comprises a loop 35 which enables a bag 31 to fasten onto the securing ring 20.

The extension straps 33 are fabricated from a material similar to the bag 31 and are attached to the perimeter edge via common sewing techniques. The extension straps 33 encompass an exterior surface of a folded and rolled bag 31. Each extension strap 33 includes an integral snap fastener 34 which fasten together for securing the bag 31 in a folded and rolled state. The loop 35 is also fabricated from a material similar to the bag 31 and is attached to the intermediate perimeter edge via common sewing techniques. The loop 35 secures a bag clip 36 which is utilized to attach the bag 31 onto the securing ring 20 during storage or non-use. The bag clip 36 is preferably a common spring clip similar to the securing ring clip 25. It is known that the extension straps 33 and loop 35 may be located in other convenient locations upon each bag 31 without limiting the scope of the invention.

FIGS. 3 through 5 illustrate the proper folding technique of the bags 31. To begin the handles 32 are folded down and the bag 31 is flattened onto itself. Next longitudinal sections of the bag 31 are folded inwardly onto itself to create a small rectangular-shape. An upper portion of the bag 31 is then rolled downwardly onto itself to create an even smaller rectangle. The extension straps 33 can then be wrapped around the bag 31 and secured.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: acquiring the system 10; clipping the securing ring clip 25 onto a desired item; utilizing the securing ring 20 to retain a plurality of reusable bag 30; unfastening the securing ring clip 25 from the desired item to remove a reusable bag 30 as desired; unfastening a bag clip 36 from the securing ring 20; unfastening the snap fastener 34 and unwrapping the extension strap 33 from around the bag 31; unrolling and unfolding the bag 31; utilizing the handles 32 to transporting and hold the bag 31; filling the interior portion 37 with desired items; utilizing as desired and removing items from the interior portion 37 as necessary; folding and rolling the bag 31 and fastening onto the securing ring 20 as needed; and, utilizing the system 10 for neat and orderly storage of reusable bags 30 along with an easy-to-use dispensing system, in a manner which is quick and effective.

The foregoing embodiments of the disclosed weighted backpack have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments of the disclosed baluster bracket assembly shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A method of securing a bag in a compact state to a securing ring comprises the following steps:

providing said securing ring, further comprising a ring clip;

providing said bag, further comprising:

a bag body, comprising a flexible and resilient structure having an outer side, an inner side, a closed bottom, and an open top defining an interior;

a loop located at a center location on a lower perimeter edge thereof;

a bag clip removably attached to said loop;

a pair of handles located on opposing sides of a perimeter edge of said top; and, a pair of straps affixed on opposing sides of a lower perimeter edge thereof and adjacent to said loop, further having a fastening means for fastening each of said pair of straps together;

folding said pair of handles down;

flattening said bag body;

folding a pair of longitudinal sections of each edge of said bag body inwardly to create a first folded state;

rolling an upper portion of said bag body downwardly onto itself to create a second folded state;

wrapping said pair of straps around said second folded state of said bag body;

securing said second folded state of said bag body with said fastening means to create said compact state; and, attaching said bag clip to said securing ring.

2. The method of claim 1, further comprising the step of removably attaching said ring clip to a support structure.

3. The method of claim 1, further comprising the step of removably attaching a plurality of bags in compact states to said securing ring.

4. The method of claim 3, further comprising the step of removably attaching said ring clip to a support structure.

* * * * *